United States Patent [19]

Hosoi

[11] Patent Number: 4,476,211

[45] Date of Patent: Oct. 9, 1984

[54] PREPARATION OF ELECTROSTATOGRAPHIC TONER MATERIAL PROVIDED WITH SURFACE ELECTROCONDUCTIVITY

[75] Inventor: Noriyuki Hosoi, Shizuoka, Japan

[73] Assignee: Fuji Photo Film Co., Ltd., Kanagawa, Japan

[21] Appl. No.: 447,992

[22] Filed: Dec. 8, 1982

[30] Foreign Application Priority Data

Dec. 11, 1981 [JP] Japan ..... 56-198649

[51] Int. Cl.[3] ..... G03G 9/16

[52] U.S. Cl. ..... 430/137; 430/138

[58] Field of Search ..... 430/137, 138, 110

[56] References Cited

U.S. PATENT DOCUMENTS 3,196,032 7/1965 Seymour ..... 430/110

4,254,201 3/1981 Sawai et al. ..... 430/138

*Primary Examiner*—John E. Kittle

*Assistant Examiner*—John L. Goodrow

*Attorney, Agent, or Firm*—Toren, McGeady and Stanger

[57] ABSTRACT

A process for the preparation of an electrostatographic toner material suitably employable for the pressure fixing process which is provided with a colored electroconductive powder on the outer surface, which comprises encapsulating pressure fixable adhesive core material containing colorant and magnetizable substance with shell material in an aqueous medium to prepare encapsulated toner particles and spray-drying the so prepared encapsulated toner particles together with the colored electroconductive powder.

8 Claims, No Drawings

PREPARATION OF ELECTROSTATOGRAPHIC TONER MATERIAL PROVIDED WITH SURFACE ELECTROCONDUCTIVITY

This invention relates to a process for the preparation of an electrostatographic toner material, and more particularly relates to a process for the preparation of a pressure fixable electrostatographic toner material comprising encapsulated toner particles.

There is known the electrostatography which comprises developing a tone electrostatic latent image contained on a photoconductive or dielectric surface with a toner material containing colorant and a fixing aid to produce a visible toner image, and transferring and fixing the visible toner image onto a surface of a support medium such as a sheet of paper.

The development of the latent image to produce a visible toner image is carried out by the use of either a developing agent consisting of a combination of toner material with carrier particles, or a developing agent consisting of toner material only. The developing process utilizing the combination of toner material with carrier particles is named "two component developing process", while the developing process utilizing only the toner material is named "one component developing process". The toner material employable in the one component developing process generally contains magnetizable substance.

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither the heating procedure nor the solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is said to be an advantageous fixing process inherently having a variety of preferably features.

However, the pressure fixing process also has a variety of inadvantageous features. For instance, the pressure fixing process generally provides poorer fixability than the heat fixing process does, whereby the toner image fixed onto a paper is apt to rub off easily. Further, the pressure fixing process requires very high pressure for the fixing, and such a high pressure tends to break the cellulose fibers of the support medium such as paper and also produces glossy surface on the support medium. Moreover, the pressing roller requires to have relatively greater size, because the roller necessarily imparts very high pressure to the toner image on the support medium. Accordingly, reduction of the size of a copying and duplicating machine cannot exceed a certain limit defined by the size of the pressing roller.

There has been previously proposed an encapsulated toner material which comprises toner particles enclosed with micro-capsules, so as to overcome the above-described disadvantageous features of the pressure fixing process. The encapsulated toner material is prepared by enclosing core particles (containing colorant such as carbon black) with shells which are rupturable by the application of pressure. The so-prepared encapsulated toner material has various advantageous features; for instance, the fixing of the encapsulated toner material does not require very high pressure, and the fixability is excellent. Accordingly, the encapsulated toner material is veiwed as suitable for the use in the pressure fixing process. However, the encapsulated toner materials proposed up to now appear unsatisfactory in practical use, because they are not able to satisfy certain characteristics required for providing smooth copying and duplicating operation and for accomplishing excellent toner image fixability and quality.

More in detail, it is required for the toner material for the use as a dry type developing agent in the electrostatography to have excellent powder characteristics (or powder flow properties) to provide high development quality, and to be free from staining the surface of the photosensitive material on which the latent image is formed. The term "powder characteristics" particularly means resistance to agglomeration and blocking of the toner particles. In the process for the preparation of an encapsulated toner material, the toner material is generally separated from a toner dispersed solution and dried through a spray-drying procedure. The previously known encapsulated toner material is apt to undergo agglomeration either in the spray-drying process, or in the storage period after the spray-drying. The so agglomerated toner material markedly degrades the resolution of the visible toner image produced on the electrostatographic latent image, whereby markedly decreasing the sharpness of the visible toner image fixed onto the support medium.

The toner material for the use as a developing agent in the pressure fixing process is further required to be satisfactory in the fixability under pressure and not to undergo off-setting against the roller surface, that is, phenomenon in which the toner adheres to the roller surface so as to stain it.

Furthermore, the toner material for the use as a developing agent specifically in the one component developing process is required to have other characteristics such as high electroconductivity at the outer surface of the particle and high magnetic susceptibility.

As for the toner material of the conventional nonencapsulated type, there is proposed in Japanese Patent Provisional Publication No. 49(1974)-5035, a toner material for the one component developing process, which is prepared by mixing a thermoplastic organic polymer with a ferromagnetizable material; hardening the mixture; pulverizing the hardened mixture to prepare powdery particles; and then providing carbon powder onto the surface of the particles under heating, whereby the carbon powder can be set on the fused surface.

As for the toner material of the encapsulated type, there are proposed a certain number of toner materials for the one component developing process, as described below.

Japanese Patent Provisional Publication No. 51(1976)81134 discloses an encapsulated toner material which encloses hydrophobic magnetizable substance within a hydrophilic film-forming polymer. However, this toner material is poor in the electroconductivity, because no processing for imparting electroconductivity is given onto the surface.

Japanese Patent Provisional Publication No. 51(1976)8023 discloses a toner material encapsulated with a double layer, into the outer layer of the which is incorporated electroconductive substance. This toner material, however, is still insufficient in the electroconductivity, because an insulating material forming the outer layer covers most part of the surface of the toner.

Japanese Patent Provisional Publication No. 52(1977)112325 discloses a toner material comprising core material containing magnetizable substance and a shell enclosing the core material, whose shell contains electroconductive substance therein. This toner material, however, likewise is insufficient in the electroconductivity, because of the same reasons described above.

The encapsulated toner materials proposed until now are not satisfactory, at least, in one of the requirements for the developing agent to be employed for the pressure fixing process.

It is, accordingly, an object of the invention to provide a process for the preparation of an electrostatographic toner material free from the drawbacks described above.

It is another object of the invention to provide a process for the preparation of an encapsulated toner material suitably employed for the pressure fixing process based on the one component developing process, and free from the drawbacks described above.

It is a further object of the invention to provide a process for the preparation of an encapsulated toner material suitably employed for the pressure fixing process, whose powder characteristics are remarkably improved.

It is a still further object of the invention to provide a process for the preparation of an encapsulated toner material having improved pressure fixability in addition to the improved powder characteristics.

It is a still further object of the invention to provide a process for the preparation of an encapsulated toner material having improved resistance to the offsetting in addition to the improved powder characteristics and the improved pressure fixability.

It is a still further object of the invention to provide a process for the preparation of an encapsulated toner material which is resistant to rupture prior to the pressing operation in the pressure fixing process, while which is readily rupturable in the pressure fixing operation.

The above-described objects and other objects which will be apparent from the hereinafter-given description are accomplished by the present invention, that is, a process for the preparation of an electrostatographic toner material which is provided with a colored electroconductive powder on the outer surface, which comprises encapsulating pressure fixable adhesive core material containing colorant and magnetizable substance with shell material in an aqueous medium to prepare encapsulated toner particles and spray-drying the so prepared encapsulated toner particles together with the colored electroconductive powder.

The shell material prepared in the invention is made of a polymer. Examples of the polymer employable as the shell material include a variety of resins such as polyurethane, polyamide, polyester, polysulfonamide, polyurea, epoxy resin, polysulfonate and polycarbonate. Preferred are polyurethane and polyurea.

The shell can be composed substantially of a complex layer. For instance, the shell can be comprise two or more polymers selected from the group consisting of polyurethane, polyurea and polyamide.

The encapsulation of the core material in the form of droplets with the shell material can be done by a known method for preparing the so-called micro-capsule containing a hydrophobic liquid, such as an interfacial polymerization method as described in U.S. Pat. Nos. 3,577,515, and 3,429,827, and British Patent Nos. 950,443, 1,091,077 and 1,091,078; an inner polymerization method as described in U.S. Pat Nos. 3,660,304, 3,726,804, 3,796,669 and 2,969,330; a phase separation method in an aqueous medium as described in U.S. Pat Nos. 2,800,457, 2,800,458, 3,041,289, and 3,205,175; an outer polymerization method as described in U.S. Pat. Nos. 4,087,376, 4,089,802, 3,100,103, and 4,001,140; and a fusion-dispersion-cooling method as described in U.S. Pat. No. 3,167,602. Other known encapsulating methods and modifications and combinations of these encapsulating methods can be also employed.

The shell material of the toner particle according to the invention is preferably produced by a polymerization reaction between two or more compounds.

The encapsulation of the invention is preferably accomplished by one of the two encapsulating methods, namely, the interfacial polymerization method and the inner polymerization method.

The interfacial polymerization method can be done in the following manner.

In the first place, the following two substances are selected:

Substance (A) which as such is a hydrophobic liquid or a substance soluble, miscible or well dispersable in a hydrophobic liquid; and Substance (B) which as such is a hydrophilic liquid or a substance soluble, miscible or well dispersable in a hydrophilic liquid, in which Substance (A) can react with Substance (B) to produce a polymerization reaction product insoluble in either the hydrophobic liquid or the hydrophilic liquid.

In the second place, very small droplets of a hydrophobic liquid including Substance (A) and the core materials such as a colorant and a pressure fixable adhesive material (binder), and having an average diameter in the range from about 0.5 to about 1,000 microns are dispersed into a hydrophilic liquid such as water containing Substance (B), in the presence of a protective colloid prepared from, for instance, a hydrophilic polymer.

A catalyst can be incorporated in either or both of the hydrophobic liquid and the hydrophilic liquid.

The substance (A) is caused to react with Substance (B) to undergo interfacial polymerization in the dispersion by an appropriate procedure, for instance, by heating the dispersion. Thus, the shells of polymerization reaction product of Substance (A) with Substance (B) and/or water are formed around the hydrophobic droplets including the core material and the colorant, and accordingly the encapsulation of the core material and the colorant with the shell is accomplished to produce encapsulated toner particles in the aqueous phase.

Examples of Substance (A) preferably employed for the preparation of the shell in the invention include compounds carrying isocyanate groups described below:

(1) Diisocyanate m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylylene1,4-diisocyanate, xylylene-1,3-diisocyanate, 4,4'-diphenylpropanediisocyanate, trimethylenediisocyanate, hexamethylenediisocyanate, propylene-1,2-diisocyanate, butylene-1,2-diisocyanate, ethylidynediisocyanate, cyclohexylene-1,2-diisocyanate, cyclohexylene-1,4-diisocyanate, p-phenylenediisocyanate, triphenylmethanediisocyanate;

(2) Triisocyanate 4,4',4"-triphenylmethanetriisocyanate, polymethylenepolyphenyltriisocyanate, toluene-2,4,6-triisocyanate;

(3) Tetraisocyanate 4,4'-dimethyldiphenylmethane-2,2',5,5'-tetraisocyanate; and (4) Polyisocyanate prepolymer an addition product of hexamethylene diisocyanate and hexanetriol, an addition product of 2,4-tolylenediisocyanate and catechol, an addition product of 2,4-tolylenediisocyanate and hexanetriol, an addition product of 2,4-tolylenediisocyanate and trimethylolpropane, an addition product of xylylenediisocyanate and trimethylolpropane.

Examples of the Substance (B) preferably employed for the preparation of the shell in the invention include compounds described below:

(1) Water;

(2) Polyol ethylene glycol, 1,4-butanediol, catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-biphenol, p,p'-biphenol, 1,1'-bi-2-naphthol, Bisphenol A, 2,2'bis(4-hydroxyphenyl)butane, 2,2'-bis(4-hydroxyphenyl)isopentane, 1,1'-bis(4-hydroxyphenyl)-cyclopentane, 1,1'-bis(4-hydroxyphenyl)-cyclohexane, 2,2'-bis(4-hydroxy-3-methylphenyl)-propane, bis(2-hydroxyphenyl)methane, xylylenediol, ethyleneglycol, 1,3-propylene glycol, 1,4-butylene glycol, 1,5-pentanediol, 1,6-heptanediol, 1,7-heptanediol, 1,8-octanediol, trimethylolpropane, hexanetriol, pentaerythritol, glycerol, sorbitol;

(3) Polyamine ethylenediamine, tetramethylenediamine, pentamethylenediamine, hexamethylenediamine, p-phenylenediamine, m-phenylenediamine, 2-hydroxytrimethylenediamine, diethylenetriamine, triethylenetetraamine, diethylaminopropylamine, tetraethylenepentaamine, an addition product of an epoxy compound and an amine compound; and (4) Piperazine piperazine, 2-methylpiperazine, 2,5-dimethylpiperazine.

In the preparation of the dispersion of the very small hydrophobic droplets containing Substance (A) and the core material, the hydrophobic liquid to be dispersed preferably contains a low-boiling solvent or a polar solvent. These solvents serve for accelerating formation of the shell which is a reaction product between the Substance (A) and the Substance (B). Examples of these solvents include methyl alcohol, ethyl alcohol, diethyl ether, tetrahydrofuran, dioxane, methyl acetate, ethyl acetate, acetone, methyl ethyl ketone, methyl isobutyl ketone, cyclohexanone, n-pentane, n-hexane, benzene, petroleum ether, chloroform, carbon tetrachloride, methylene chloride, ethylene chloride, carbon disulfide and dimethylformamide.

The encapsulated toner material whose shell is composed substantially of a complex layer comprising two or more polymers selected from the group consisting of polyurethane, polyurea and polyamide can be produced as follows:

In a hydrophobic liquid comprising core materials such as a colorant, and a pressure fixable adhesive material (binder), are dissolved an acid chloride and a polyisocyanate. This solution is then dispersed in an aqueous medium comprising a polyamine or piperazine and a dispersing agent to produce fine droplets of the core material having an average diameter in the range from about 0.5 to about 1,000 microns in the aqueous medium.

The dispersion produced above is then neutralized or made weak-alkaline by addition of an alkaline substance, and subsequently heated to a temperature between 40° and 90° C. Upon completion of these procedure, a complex layer consisting substantially of a polyamide and a polymethane, in which the polyamide is a reaction product produced by reaction between the acid chloride and the polyamine, and the polyurea is a reaction product produced by reaction between the polyisocyanate and the polyamine, is formed around the droplet of core material. Thus, the encapsulated particle having the complex layer shell is obtained.

If a polyol is further added to the hydrophobic liquid in the above, there is produced around the hydrophobic core material droplet a complex layer shell consisting substantially of the polyamide and a polyurethane, in which the polyurethane is a reaction product of the polyisocyanate with the polyol.

In the latter procedure, a complex layer consisting substantially of the polyamide, polyurea and polyurethane can be produced, if the polyamine is introduced into the reaction system in an amount exceeding the amount required to react the introduced acid chloride.

The shell of the so produced particle is, as described above, a complex layer shell. The term "complex layer shell" means a shell comprising a polymer mixture, as well as a double layer shell. The term "double layer shell" is not intended to mean only a shell in which the two layers are completely separated by a simple interface, but include a shell in which the interface is not clearly present in the shell, but the ratio between one polymer and another polymer (or other polymers) varies from the inner phase to the outer phase of the shell.

Examples of acid chlorides include adipoyl chloride, sebacoyl chloride, phthaloyl chloride, isophthaloyl chloride, terephthaloyl chloride, fumaroyl chloride, 1,4-cyclohexanedicarbonyl chloride, 4,4'-biphenyldicarbonyl chloride, 4,4'-sulfonyldibenzoyl chloride, phosgene, polyesters containing acid chloride groups, and polyamides containing acid chloride groups.

The acid chloride can be replaced with a dicarboxylic acid or its acid anhydride. Examples of the dicarboxylic acids include adipic acid, sebacic acid, phthalic acid, terephthalic acid, fumaric acid, 1,4-cyclohexanedicarboxylic acid and 4,4'-biphenyldicarboxylic acid. Examples of the acid anhydrides include phthalic anhydride.

The inner polymerization method can be done in the following manner.

In a hydrophobic liquid to form the core material of the encapsulated toner particle are dissolved substance (A) and one or more substances polymerizable with the Substance (A) so as to produce a shell material, in the presence of a low boiling solvent or a polar solvent. The so obtained hydrophobic liquid is dispersed and emulsified in the aforementioned hydrophilic liquid which is not miscible with the hydrophobic liquid. The emulsion is then heated to cause removal of the low boiling solvent or polar solvent to the outside of the hydrophobic liquid droplet and simultaneously to move the shell-forming substances to the surface of the droplet. The shell-forming substances are polymerized at the surface to prepare the desired shell. Thus, the desired encapsulated toner particles dispersed in the hydrophilic liquid are obtained.

As for the other aspects of the interfacial polymerization method and the other processes for the preparation of micro-capsules containing a hydrophobic liquid, there are given descriptions in U.S. Pat. No. 3,726,804, which is introduced hereinto as reference.

The core material of the invention contains colorant for producing a visible image from the latent image. The colorant generally is a dye or a pigment, but a certain agent providing no directly visible image such as a fluorescent substance can be employed as the colorant, if desired.

The colorant is generally selected from a variety of the dye, pigment and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivative dye; yellow colorants such as a benzidine derivative colorant, that is generally called Diazo Yellow; and red colorants such as Rhodamine B Lake that is a double salt of xanthin dye with phosphorus wolframate and molybdate, Carmine 6B belonging to Azo pigment, and a quinacridone derivative.

The core material of the invention further contains a binder (adhesive material) for keeping the colorant within the core and assisting the fixing of the colorant onto the surface of a support medium such as paper. The binder is generally selected from highboiling liquids conventionally employed or proposed for employment for finely dispersing an oil-soluble photographic additive within an aqueous medium to incorporate the additive into a silver halide color photosensitive material, or selected from polymers proposed for employment as the binders for the pressure fixable encapsulated toner materials.

Examples of the high-boiling liquids include the following compoundshaving the boiling point of higher than 180° C.:

(1) Phthalic esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl) phosphate, tributyl phosphate, trihexyl phosphate, trioctyl phosphate, trinonyl phosphate, tridecyl phosphate, trioleyl phosphate, tris(butoxyethyl) phosphate, tris(chloroethyl) phosphate, tris(dichloropropyl) phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate;

(5) Aliphatic acid esters hexadecyl myristate, dibutoxyethyl succinate, dioctyl adipate, dioctyl azelate, decamethylene-1,10diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphthalene, ethylnaphthalene, diethylnaphthalene, triethylnaphthalene, monoisopropylnaphthalene, diisopropylnaphthalene, tetraisopropylnaphthalene, monomethylethylnaphthalene, isooctylnaphthalene;

(7) Dialkylphenyl ethers di-o-methylphenyl ether, di-m-methyldiphenyl ether, di-p-methylphenyl ether;

(8) Amides of fatty acids and aromatic sulfonic acid

N,N-dimethyllauroamide, N,N-diethylcaprylamide, N-butylbenzenesulfonamide;

(9) Trimellitic acid esters trioctyl trimellitate;

(10) Diarylalkanes diarylmethanes such as dimethylphenylphenylmethane, diarylethanes such as 1-methylphenyl-1-phenylethane, 1-dimethylphenyl-1-phenylethane and 1-ethylphenyl-1-phenylethane.

The above-listed high-boiling liquids and examples of other high-boiling liquids employable in the invention are described in detail in the following publications: Japanese Patent Publication Nos. 46(1971)-23,233 and 49(1974)-29,461; Japanese Patent Provisional Publication Nos. 47(1972)-1,031, 50(1975)-62,632, 50(1975)-82,078, 51(1976)-26,035, 51(1976)-26,036, 51(1976)-26,037, 51(1976)-27,921, and 51(1976)-27,922; U.S. Pat. Nos. 2,322,027, 2,353,262, 2,533,514, 2,835,579, 2,852,383, 3,287,134, 3,554,755, 3,676,137, 3,676,142, 3,700,454, 3,748,141, 3,837,863, and 3,936,303; British Patent Nos. 958,441, 1,222,753, 1,346,364, and 1,389,674; and West Germany Offenlegungsschrift No. 2,538,889.

For the purpose of the invention, the high-boiling liquid is preferably selected from the phthalic acid esters, phosphoric acid esters and alkylnaphthalenes.

Examples of the polymers include the following polymers:

polyolefins, olefin copolymers, polystyrene, styrenebutadiene copolymer, epoxy resins, polyesters, natural and synthetic rubbers, polyvinylpirolidone, polyamides, cumarone-indene copolymer, methyl vinyl ether-maleic anhydride copolymer, maleic acid-modified phenol resin, phenol-modified terpene resin, silicone resins, epoxy-modified phenol resin, amino resins, polyurethane elastomers, polyurea elastomers, homopolymers and copolymers of acrylic acid ester, homopolymers and copolymers of methacrylic acid ester, acrylic acid-long chain alkyl methacrylate copolymer oligomer, poly(vinyl acetate), and poly(vinyl chloride).

The above-listed polymers and examples of other polymers employable in the invention are described in detail in the following publications:

Japanese Patent Publication Nos. 48(1973)-30,499, 49(1974)-1,588 and 54(1979)-8,104; Japanese Patent Provisional Publication Nos. 48(1973)-75,032, 48(1973)-78,931, 49(1974)-17,739, 51(1976)-132,838, 52(1977)-98,531, 52(1977)-108,134, 52(1977)-119,937, 53(1978)-1,028, 53(1978)-36,243, 53(1978)-118,049, 55(1980)-89,854 and 55(1980)-166,655; and U.S. Pat. Nos. 3,788,994 and 3,893,933.

The core material of the invention can further contain a magnetizable substance, preferably in the form of fine particles.

As for the magnetizable substances, there are given descriptions, for instance, in Japanese Patent Provisional Publication Nos. 53(1978)-118,053, 53(1978)-1,028 and 55(1980)-166,655. Examples of materials of the magnetizable substances include metals such as cobalt, iron and nickel; metal alloys or metal compositions comprising aluminum, cobalt, copper, iron, lead, magnesium, nickel, tin, zinc, gold, silver, antimony, beryllium, bismuth, cadmium, calcium manganese, titanium, tungsten, vanadium and/or zirconium; metallic compounds including metal oxides such as aluminium oxide, ferric oxide, cupric oxide, nickel oxide, zinc oxide, zirconium oxide, titanium oxide and magnesium oxide; refractory metal nitrides such as chromium nitride; metal carbides such as tungsten carbide and silica carbide; ferromagnetic ferrite; and their mixtures.

The releasing agent can be further contained in the core material for keeping the ruptured shell and the released core material from adhering to the surface of the pressing roller. The releasing agent can be chosen from those proposed for employment in the previously reported encapsulated toners. Examples of the releasing agents include a fluorine-containing resin described in Japanese Patent Provisional Publication Nos. 55(1980)-142,360 and 55(1980)-142,362.

As mentioned hereinbefore, a process for the preparation of the encapsulated toner particles includes a stage for dispersing or emulsifying very small droplets of the hydrophobic liquid containing Substance (A) and the core material in the aqueous medium. For the preparation of the homogeneous dispersion (or emulsion) of the very small droplets of the hydrophobic liquid, it is preferred to incorporate into the reaction liquid a hydrophilic protective colloid and/or an emulsifying surface active agent which assist the production of the homogeneous dispersion (or emulsion) of the hydrophobic droplets and prevention of agglomeration of the soproduced hydrophobic droplets. The hydrophilic protective colloid and the surface active agent can be employed alone or in combination.

Examples of the preferred hydrophilic protective colloids include proteins such as gelatin, graft polymers of gelatin and other polymers, albumin, and casein; cellulose derivatives such as hydroxyethylcellulose, carboxymethylcellulose, and cellulose sulfuric acid ester, saccharide derivatives such as sodium alginate and starch derivatives; and a variety of synthetic hydrophilic homopolymers and copolymers such as polyvinyl alcohol, partially acetalized polyvinyl alcohol, poly-N-vinyl pyrrolidone, polyacrylic acid, polyacrylic amide, polyvinylimidazole and polyvinylpyrazole.

In the above-listed examples, the gelatin can be a lime-treated gelatin, an acid-treated gelatin, a hydrolyzed gelatin, and an enzymically decomposed gelatin. The graft polymers of gelatin and other polymers can be gelatins carrying graft chains consisting of homopolymers or copolymers of vinyl monomers such as acrylic acid, methacrylic acid, their derivatives, e.g., esters and amides, acrylonitrile, and styrene. Examples of the gelatin graft polymers are those miscible with gelatin such as the gelatin carrying the graft chains consisting of polymer of acrylic acid, methacrylic acid, acrylamide, methacrylamide or hydroxyalkyl methacrylate.

Details of these preferred gelatin graft polymers are described in U.S Pat. Nos. 2,763,625, 2,831,767, and 2,956,884.

Representative examples of the synthetic hydrophilic polymers are described, for instance, in West German Offenlegungsschrift No. 2,312,708, U.S. Pat. Nos. 3,620,751 and 3,879,205, and Japanese Patent Publication No. 43(1968)-7,561.

The surface active agents for dispersing or emulsifying the hydrophobic liquid in the hydrophilic liquid medium can be incorporated into either or both of the hydrophobic liquid and the hydrophilic liquid medium.

Examples of the surface active agents include nonionic surface active agents, for instance, saponin (steroide type), alkylene oxide derivatives such as polyethylene glycol, polyethylene glycol/polypropylene glycol condensation product, alkyl- or alkylarylether of polyethylene glycol, polyethylene glycol esters, polyethylene glycol sorbitol ester, alkylamine or amide of polyalkylene glycol, polyethylene oxide adduct of silicone polymer, glycidol derivatives such as polyglyceride alkenylsuccinate and alkylphenol polyglyceride, fatty acid esters of polyhydric alcohols, alkylesters of saccharide, urethanes and ethers; and anionic surface active agents having acidic groups such as carboxy, sulfo, phospho, sulfate ester and phosphate ester groups, for instance, triterpenoide-type saponin, alkylcarboxylic acid salts, alkylsulfonic acid salts, alkylbenzenesulfonic acid salt, alkylnaphthalenesulfonic salts, alkylsulfate esters, alkylphosphate esters, N-acyl-N-alkyl-taurines, sulfosuccinic acid esters, sulfoalkyl-polyoxyethylene alkyl phenyl ethers, and polyoxyethylene alkylphosphate esters.

Particularly preferred surface active agents are anionic surface active agents belonging to the sulfonic acid type and the sulfate ester type, namely, compounds having in the molecular structure both of hydrophobic groups containing 8–30 carbon atoms and hydrophilic groups of $—SO_3M$ or $—OSO_3M$ (in which M is Na or K). These preferred anionic surface active agents belonging to the above-mentioned types are described in detail in "Surface Active Agents" (A.W.Perry; Interscience Publication Inc., New York).

Representative examples of the preferred anionic surface active agents are as follows: sodium dodecylsulfate, sodium tetradecylsulfate, Turkey red oil, sodium dodecylcarboxyamidoethylsulfate, sodium dodecylsulfonate, sodium tetradecylsulfonate, sodium polyoxyethylene-octylphenyl-ethersulfonate, sodium salt of sulfosuccinic acid dioctylester, sodium dodecylbenzenesulfonate, sodium tetradecylamidophenylsulfonate, and sodium tri-isopropylnaphthalenesulfonate.

Dispersing or emulsifying the reaction liquid can be carried out by means of a known homogenizer such as one belonging to the stirring type, the high pressure injecting type, the ultrasonic vibrating type and the kneader type. Particularly preferred homogenizers are a colloid mill, a conventional homogenizer, and electromagnetic distortion inducing ultrasonic homogenizer.

The encapsulated toner is then produced, for instance, by heating the emulsified reaction liquid in the presence of an appropriate catalyst, as described hereinbefore, so as to form shells around the core material droplets. Subsequently, the encapsulated toner is separated from the aqueous reaction medium and dried to obtain a dry encapsulated toner. The encapsulated toner is preferably washed with water after the separation from the aqueous reaction medium and prior to the drying procedure.

According to the present invention, the encapsulated toner is dried by spray-drying the aqueous dispersion of the encapsulated toner particles together with a colored electroconductive powder.

As described hereinbefore, it is known that a surface of an electrostatographic toner can be rendered electroconductive by incorporation of a colored electroconductive powder, even though the electroconductivity given by the conventional art is not at a satisfactory level. These known colored electroconductive powder can be employed in the invention. Among the electroconductive powders, an electron-conductive fine powder is preferred, because it is less influenced by humidity. Further, the volume resistance of the electroconductive powder preferably is not higher than $10^7$ Ω·cm, and more preferably is not higher than $10^5$ Ω·cm. Examples of the preferred electroconductive powder include carbonaceous powders such as carbon black and graphite, metal powders, and crystalline metal oxide powders. Particularly preferred are the carbonaceous powders such as carbon black and graphite, because their volume resistances are sufficiently low and these are easily obtainable on market.

The electroconductive powder employed in the invention generally is of a particle size of not greater than 2 μm, preferably not greater than 0.5 μm.

The spray-drying procedure is well known to those skilled in the art. Accordingly, no detailed description on the spray-drying procedure is necessary.

The spray-drying of the encapsulated toner particles together with the colored electroconductive powder can be carried out in any of the known procedure. As for the spraying system, there are known various means such as a pressurized nozzle, a rotary disk, or a double flow nozzle. As for the drying system, there are known various processes such as a horizontal parallel flow process, a vertical descending parallel flow process, a vertical ascending counterflow process, and a vertical descending mixed flow process. The conditions for the spray-drying employed in the invention can be set in accordance with the conventional conditions.

In the invention, the colored electroconductive powder can be introduced into the dispersion of the encapsulated toner particles prior to the spray-drying. Otherwise, a dispersion of the electroconductive powder in an appropriate medium is individually prepared, and the dispersion of the toner particles and the dispersion of the electroconductive powder can be joined in a spraydryer. In either case, a surface active agent is preferably introduced into a dispersion of the electroconductive powder to produce a homogeneous dispersion.

The electroconductive powder is generally employed in the amount of 0.1–10 percent by weight of the amount of the toner particles (dry basis). However, the amount of the electroconductive powder can be varied optionally.

The so dried encapsulated toner particles are preferably heated to improve their powder characteristics. The temperature for heating the dried encapsulated toner particles preferably ranges from 50° to 300° C., and more preferably ranges from 80°–150° C. The period required for the heating procedure varies with the heating temperature, the nature of the binder, and so on. Generally, the period ranges from 10 minutes to 48 hours, and preferably ranges from 2 to 24 hours.

There is no limitation on means employed for carrying out the heating procedure. Examples of the heating means include an electric furnace, a muffle furnace, a hot plate, an electric drying oven, a fluid bed drying apparatus, and an infrared drying apparatus.

The electrostatographic toner material obtained as above carries on the surface the electroconductive powder which is well fixed onto the surface so that it is relatively free from dropping off therefrom.

The electroconductive powder can be provided onto the surface of an electrostatographic toner material by admixing the toner material with the electroconductive powder after preparing a dry toner material. However, this process hardly produces a satisfactory electroconductive toner material, because the electroconductive powder is not stably fixed onto the surface of the toner material and is apt to drop off in a developing apparatus. Moreover, it is also disadvantageous that the colored electroconductive powder released from the toner material brings stains on a paper sheet receiving a visible toner image.

Accordingly, the electrostatographic toner material prepared by the invention has a satisfactory electroconductivity and does hardly bring stains on a paper sheet receiving the visible toner image.

The dry encapsulated toner can be admixed with an insulating material and/or a charge controller such as a metal-containing dye or Nigrosin dye.

The dry encapsulated toner can be admixed with a flow lubricant such as hydrophobic silica powder so that the flow lubricant can be dispersed over the surface of the encapsulated toner. The encapsulated toner having the flow lubricant such as hydrophobic silica powder over the toner surface shows particularly improved powder quality and property, and accordingly is very advantageous in the practical use.

The encapsulated toner obtained as above can be introduced into the electrostatographic copying and duplicating machine to develop an electrostatographically produced latent image so as to produce a visible toner image on the surface of the photoconductive material. The visible image is then fixed onto a support medium such as paper by means of an appropriate pressure fixing apparatus. There is no limitation on the pressure fixing apparatus for fixing the encapsulated toner of the invention, and any known apparatus can be applied to the fixing of the encapsulated toner of the invention. Examples of the pressure fixing apparatuses include those illustrated in Japanese Patent Publication Nos. 44(1969)-9,880, 44(1969)-12,797, and 46(1971)-15,876; and Japanese Patent Provisional Publication Nos. 49(1974)-62,143, 49(1974)-77,641, 50(1975)-51,333, 51(1976)-31,235, 51(1976)-40,351, 52(1977)15,335, 52(1977)-102,743, 54(1979)-28,636, 54(1979)-32,326, 54(1979)-41,444, and 54(1979)48,251.

The electrostatographic toner material comprising the encapsulated toner particles of the invention has improved powder characteristics, and is resistant to the mechanical shock and abrasion in the developing apparatus of the electrostatographic copying and duplicating machine. Further, the electrostatographic toner material of the invention is easily rupturable in the pressure fixing apparatus to produce a visible toner image well fixed onto the support medium such as paper. Furthermore, the toner material of the invention hardly undergoes off-setting to a pressing roller and hardly undergoes the so-called filming on the surfaces of the carrier particles, the developing sleeves and the photoconductive material.

In the employment for the one component developing process, the toner material of the invention is well qualified in the developing characteristics such as for producing a very clear visible image, the pressure fixing characteristics and the resistance to the offsetting. Moreover, no filming is produced on the surfaces of the development sleeve and photosensitive material.

Other features of the electrostatographic copying and duplicating process employing an encapsulated toner material are described in U.S. Pat. No. 3,788,994, which is introduced hereinto as reference.

The present invention will be illustrated by the following examples which are by no means intended to introduce any restiriction into the invention.

EXAMPLE 1

Into a dispersion of 3 g. of carbon black and 15 g. of magnetite in 27 g. of dibutyl phthalate was introduced 10 g. of a mixture of acetone and methylene chloride (1:3, volume ratio), and the mixture was then admixed to become homogeneous.—Primary liquid.

Subsequently, 4 g. of an adduct of hexamethylene diisocyanate with hexanetriol (3:1 molar ratio adduct) and 0.05 g. of dibutyltin laurate (catalyst) were added to the primary liquid at room temperature.—Secondary liquid.

Independently, 3 g. of gum arabic was dissolved in 57 g. of water at 20° C., and into this solution under vigorous stirring was poured little by little the secondary liquid. Thus, there was obtained an oil-in-water emulsion containing oily droplets having average diameter of 5–15 μm. The procedure for the preparation of the emulsion was carried out under cooling the reaction vessel for keeping the temperature of the emulsion below 20° C.

To the emulsion was further added under stirring 100 g. of water heated to 40° C. After completion of the addition of water, the emulsion was gradually heated to 90° C. over 30 min. The emulsion was kept under stirring at the temperature for 20 min. so as to complete the encapsulating reaction.

The dispersion containing the encapsulated oily particles was subjected to centrifugal separation at 5,000 r.p.m. to separate the encapsulated particles from the aqueous gum arabic solution.

Independently, an aqueous carbon black dispersion was prepared from 6.4 g. of water, 3.6 g. of carbon black and 0.2 g. of a surface active agent (sodium dodecylbenzenesulfonate).

To the slurry containing the encapsulated particles separated by the centrifugal process were added 100 g. of water and 10.2 g. of the aqueous carbon black dispersion. The mixture was then subjected to spray-drying employing a mini-spray HO (produced by Yamato Science Co. Ltd., Japan) under the conditions of the entrance temperature: 120° C., the exit temperature: 100° C. and the atomizing pressure: 1 kg./cm$^2$ to obtain a powdery electroconductive toner material.

The electroconductive toner material was employed in the one component developing process to develop a latent image produced in a conventional electrostatographic process through magnetic brush development so as to produce a visible image. The visible toner image was then converted onto a paper.

The paper carrying the toner image was treated under a pressing roller at a pressure of 350 kg./cm$^2$ There was obtained a toner image with high sharpness and well fixed onto the paper. Further, the off-setting of the toner was at a very low level.

EXAMPLE 2

The electroconductive toner material obtained in Example 1 was heated at 100° C. for 6 hours in an oven, and then examined on the powder characteristics. It was confirmed that the flow property of the toner material was improved.

The so heat-treated electroconductive toner material was employed in the one component developing process as in Example 1. There was obtained a toner image with higher sharpness than one obtained in Example 1, and the toner image was well fixed onto the paper.

EXAMPLE 3

In 50 g. of hot water at approximately 80° C. was dissolved 2.5 g. of polyvinylbenzenesulfonic acid partly in the form of sodium salt(mean molecular weight 500,000) under stirring. The solution was cooled, and aqueous sodium hydroxide (20% by weight aqueous solution) was added to the cooled solution to adjust the pH to 4.0.

Into the so produced aqueous solution was poured a primary solution prepared in the same manner as described in Example 1, so as to obtain an oil-in-water emulsion containing oily droplets having average diameter of 5–25 μm.

Independently, 3 g. of melamine, 5 g. of aqueous formaldehyde (37% by weight solution) and 40 g. of water were stirred at 60° C. to produce a clear solution containing melamine, formaldehyde and a precondensate of melamine and formaldehyde.

The clear solution was then added to the emulsion, and the mixture was adjusted to pH 6.0 with aqueous acetic acid (20% by weight). The aqueous mixture was subsequently heated to 65° C. and kept at the temperature for 60 minutes under stirring. Thereafter, the aqueous mixture was adjusted to pH 4.0 with 1-N hydrochloric acid, and to the mixture was added 15 g. of aqueous urea (40% by weight solution). The aqueous mixture was further stirred at 65° C. for 40 minutes, and again adjusted to pH 9.0 with aqueous sodium hydroxide (20% by weight solution), completing the encapsulating reaction.

The dispersion containing the encapsulated particles was subjected to centrifugal separation at 5,000 r.p.m. to separate the encapsulated particles from the aqueous polyvinylbenzenesulfonate solution.

To the slurry containing the encapsulated particles separated as above were added 100 g. of water and 10 g. of a colloidal graphite dispersion. The mixture was then subjected to spray-drying employing a mobil-miner spray dryer (produced by Nitro-atomizer Corporation) under the conditions of the entrance temperature: 140° C., the exit temperature: 120° C. and the atomizing pressure: 1 kg./cm$^2$ to obtain a powdery electroconductive toner material.

The electroconductive toner material was employed in the one component developing process to develop a latent image produced in a conventional electrostatographic process through magnetic brush development so as to produce a visible image. The visible toner image was then converted onto a paper.

The paper carrying the toner image was treated under a pressing roller at a pressure of 350 kg./cm$^2$ There was obtained a toner image with high sharpness and well fixed onto the paper. Further, the offsetting of the toner was at a very low level.

EXAMPLE 4

The electroconductive toner material obtained in Example 3 was heated at 100° C. for 6 hours in an oven, and then examined on the powder characteristics. It was confirmed that the flow property of the toner material was improved.

The so heat-treated electroconductive toner material was employed in the one component developing process as in Example 3. There was obtained a toner image with higher sharpness than one obtained in Example 3, and the toner image was well fixed onto the paper.

EXAMPLE 5

A solution of 4 g. of polythiol-type polysulfide resin (Thiokol LP-2, trade mark of Thiokol Corporation) in 10 g. of methylene chloride was mixed with a dispersion consisting of 15 g. of magnetite powder, 1 g. of carbon black, and 14 g. of dibutyl phthalate to prepare a primary liquid. To the primary liquid were added 6 g. of diphenylmethane-4,4′-diisocyanate and 0.05 g. of N,N-dimethylbenzylamine (catalyst) to prepare a secondary liquid.

Into a solution of 0.6 g. of phthalated gelatin and 0.5 g. of Turkey red oil in 20 g. of water at 15° C. under vigorous stirring was poured little by little the secondary liquid. Thus, there was obtained an oil-in-water type emulsion containing oily droplets having average diameter of 10–15 μm. The procedure for the preparation of the emulsion was carried out under coolng the reaction vessel for keeping the temperature of the emulsion below 15° C.

To the emulsion was further added under stirring 100 g. of water heated to 60° C. After completion of the addition of water, the emulsion was gradually heated to 95° C. over 30 min. The emulsion was then kept under stirring at the temperature for 60 min. so as to complete the encapsulating reaction.

The so prepared dispersion was subjected to centrifugal separation at 5,000 r.p.m. to separate the encapsulated particles from the gum arabic-containing aqueous solution.

To the slurry containing the encapsulated particles separated by the centrifugal process were added 100 g. of water and 10.2 g. of the aqueous carbon black dispersion. The mixture was then subjected to spray-drying employing a mini-spray HO (produced by Yamato Science Co., Ltd., Japan) under the conditions of the entrance temperature: 120° C., the exit temperature: 100° C. and the atomizing pressure: 1 kg./cm$^2$ to obtain a powdery electroconductive toner material.

The electroconductive toner material was employed in the one component developing process to develop a latent image produced in a conventional electrostatographic process through magnetic brush development so as to produce a visible image. The visible toner image was then converted onto a paper.

The paper carrying the toner image was treated under a pressing roller at a pressure of 350 kg./cm$^2$ There was obtained a toner image with high sharpness and well fixed onto the paper. Further, the offsetting of the toner was at a very low level.

EXAMPLE 6

The electroconductive toner material obtained in Example 5 was heated at 100° C. for 6 hours in an oven, and then examined on the powder characteristics. It was confirmed that the flow property of the toner material was improved.

The so heat-treated electroconductive toner material was employed in the one component developing process as in Example 5. There was obtained a toner image with higher sharpness than one obtained in Example 5, and the toner image was well fixed onto the paper.

COMPARISON EXAMPLE 1

To a slurry containing encapsulated particles prepared and separated by the centrifugal process in the same manner as in Example 1 was added 100 g. of water. The mixture was then spray-dried in the same manner as in Example 1 to obtain a powdery encapsulated toner material.

20 g. of the above-obtained powdery toner material was well mixed with 1.2 g. of carbon black to provide the carbon black onto the surface of the toner material.

The electroconductive toner material obtained as above was subjected to the one component developing process in the same manner as in Example 1. The visible toner image was then converted onto a paper.

The paper carrying the toner image was treated under a pressing roller at a pressure 350 kg./cm$^2$ There was obtained a toner image with poor sharpness, and a paper sheet receiving the toner image was stained with carbon black released from the toner material.

I claim:

1. A process for the preparation of an electrostatographic toner material comprising encapsulated toner particles having colored electroconductive powder affixed to their outer surface, which comprises encapsulating a pressure fixable adhesive core material containing a colorant and a magnetizable substance with a shell material selected from the group consisting of polyurethane, polyamide, polyester, polysulfonamide, polyurea, epoxy resin and polysulfonates, in an aqueous medium to prepare encapsulated toner particles and spray-drying the thus prepared encapsulated toner particles together with the colored electroconductive powder.

2. The process as claimed in claim 1, in which the colored electroconductive powder is a powdery carbonaceous substance.

3. The process as claimed in claim 2, in which the carbonaceous substance is carbon black.

4. The process as claimed in claim 1, in which the spray-dried encapsulated toner particles are heated to a temperature ranging from 50° to 300° C.

5. The process as claimed in claim 1, in which the shell material is polyurethane, polyurea or a mixture thereof.

6. The process as claimed in claim 1, in which the encapsulation of the core material is accomplished by an interfacial polymerization method.

7. The process as claimed in claim 6, in which the interfacial polymerization is accomplished using polyisocyanate, polyol and/or polyamide.

8. The process as claimed in claim 1, in which the encapsulation of the core material is accomplished by an inner polymerization method.

* * * * *